US007494214B2

(12) United States Patent
Nitta et al.

(10) Patent No.: US 7,494,214 B2
(45) Date of Patent: Feb. 24, 2009

(54) RECORDING APPARATUS WITH FIRST AND SECOND SHEET FEEDING PORTIONS

(75) Inventors: Tetsuhiro Nitta, Yokohama (JP); Shinya Sonoda, Yokohama (JP); Hiroyuki Tanaka, Kawasaki (JP); Kazuhisa Kawakami, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 358 days.

(21) Appl. No.: 11/148,259

(22) Filed: Jun. 9, 2005

(65) Prior Publication Data

US 2005/0275705 A1 Dec. 15, 2005

(30) Foreign Application Priority Data

Jun. 14, 2004 (JP) ..... 2004-174967

(51) Int. Cl.
*B41J 2/01* (2006.01)

(52) U.S. Cl. ..... 347/104; 347/101

(58) Field of Classification Search ..... 347/104, 347/101

See application file for complete search history.

(56) References Cited

U.S. PATENT DOCUMENTS 5,228,680 A * 7/1993 Sugiura ..... 271/259
5,847,719 A * 12/1998 Yamaguchi et al. ..... 346/134
6,736,501 B2 5/2004 Yamaguchi et al. ..... 347/104
2002/0118266 A1 * 8/2002 Yamaguchi et al. ..... 347/104

FOREIGN PATENT DOCUMENTS

CN 1490166 A 4/2004
JP 2001-246759 9/2001

OTHER PUBLICATIONS

Office Action (English Translation)/Search Report, issued by The Patent Office of the People's Republic of China, in Chinese Application No. 2005100780818, on Dec. 29, 2006.
Translation of Vietnamese Official Action, issued May 23, 2008, in Vietnamese Patent Application No. 1-2005-00779.

* cited by examiner

*Primary Examiner*—Manish S Shah
(74) *Attorney, Agent, or Firm*—Fitzpatrick, Cella, Harper & Scinto

(57) ABSTRACT

A recording apparatus for effecting recording on a material by a recording unit, the apparatus having a carriage for reciprocal movement while carrying the recording unit; a platen for support of the recording material at a position opposed to the recording unit; a feeding roller for feeding the recording material; a pinch roller driven by the feeding roller; a sheet feeding unit for feeding the recording material to the position opposed to the recording unit; a base unit supporting the recording unit, the platen, the feeding roller and the sheet feeding unit at respective positions.

12 Claims, 15 Drawing Sheets

RECORDING APPARATUS WITH FIRST AND SECOND SHEET FEEDING PORTIONS

FIELD OF THE INVENTION AND RELATED ART

The present invention relates to a recording apparatus which records images with the use of a recording means which is moved relative to recording medium in the direction intersectional to the direction in which recording medium is conveyed by recording medium conveyance rollers.

A recording apparatus such as a printer, a copying machine, a facsimileing machine, etc., is structured so that recording is made on recording medium with the use of a recording means such as a recording head. As one of the various forms of a recording apparatus, there is a recording apparatus of the serial type, which forms images on recording medium with the use of a recording means mounted on a carriage which is moved in the primary scan direction relative to the recording medium which is conveyed by a recording medium conveyance mechanism in the secondary scan direction. As the recording medium for a recording apparatus of the serial type, it is possible to use a sheet of various media, for example, recording paper, thin plate of plastic, OHP sheet, fabric, etc. As the recording method employed by the recording means employed by a recording apparatus of the serial type, various recording methods have been known, for example, the thermal method, thermal transfer method, ink jet method, laser beam method, wire-dot method, etc. Among the recording apparatuses which employ one of the abovementioned recording methods, an ink jet recording apparatus, that is, a recording apparatus employing the ink jet recording method, which records images by ejecting ink onto recording medium from its recording means enjoys various advantages in that it is higher in recording speed, and lower in recording noise, while being lower in operational cost. Further, it is easy to reduce in size, and also, easy to use for color recording.

FIG. 14 is a side view of a typical recording apparatus in accordance with the prior art, and FIG. 15 is a side view of the typical recording apparatus in accordance with the prior art. In the following description of any of the recording apparatuses in accordance with the prior art as well as the present invention, the portion of the recording apparatus having a sheet delivery tray is referred to as front side, and the left side of the recording apparatus as seen from the front side is referred to as left side of the recording apparatus. In FIGS. 14 and 15, the printer unit 520 (recording unit) is provided with a bottom case 519, and a chassis 501 which is U-shaped overall.

The chassis 501 is formed of a piece of plate, and has a virtually vertical rear wall, and a pair of lateral walls perpendicular to the rear wall. The chassis 501 is solidly fixed to the bottom case 519. Between the pair of lateral walls of the chassis 501, a guide shaft 504 is supported, to the left and right ends of which an unshown pair of shaft cams 540 are solidly fixed. The guide shaft 504 is supported by the chassis 501 with the interposition of this pair of shaft cams 540.

The carriage 506, which is carrying the recording head 508, is supported by the guide shaft 504 so that it can be reciprocally moved along the guide shaft 504. The shaft cams are supported by the chassis 501 so that they can be rotated relative to the chassis 501 to vertically move the guide shaft 504. The distance between the recording head 508 and recording medium can be adjusted by changing the vertical position of the recording head 508 by vertically moving the guide shaft 504.

The carriage 506 is supported by the guide shaft 504 and the guiding portion of the chassis 501, so that the carriage 506 is guided by the guide shaft 504 and guiding portion. The guide shaft 504 and the guiding portion of the chassis 501 are disposed in parallel to each other. The carriage 506 can be reciprocally moved by the drive belt 510, by driving the unshown carriage motor. The recording head 508 is mounted on the carriage 506 so that the surface of the recording head 508 having the ejection orifices is positioned below the bottom surface of the carriage 506. To the rear surface of the carriage 506, the substrate 534 for controlling the recording head 508 is solidly attached. To the front surface of the rear wall of the chassis 501, an encoder 507 is attached. The position of the carriage 506 is detected as the sensor of the carriage 506 reads the encoder 507. The signals which indicate the position of the carriage 506 are used for controlling the carriage 506 and recording head 508.

On the bottom case 519, an automatic sheet feeding portion 517 is disposed, which is provided with a pressure plate 526 and a feeder tray 527, which are tilted relative to the bottom case 519. Against the combination of the pressure plate 526 and feeder tray 527, a plurality of recording mediums 524 are placed in layers. The pressure plate 526 is rotatably attached by its top edge portion to the ASF base 525, with which the bottom case 519 is provided. The pressure plate 526 is kept pressured frontward by the force from springs which press on the bottom portion of the pressure plate 526. Thus, as the recording mediums 524 are placed in the feeder tray 527, the bottom portion of each recording mediums 524 can be pressed against a feed roller 528 by the pressure plate 526.

The feed roller 528 is rotatably supported by the ASF base, by its shaft. Opposing the feed roller 528 is the separation roller 529 for separating the recording mediums 524. The feed roller 528 feeds the recording mediums 524 into the main assembly of the recording apparatus by being driven by an unshown driving force source as a recording operation begins. The movement of the pressure plate 526 is tied to that of the feed roller 528 by an unshown cam, so that when one of the recording mediums 524 needs to be fed into the main assembly, the pressure plate 526 presses the recording mediums 524 against the feed roller 528, whereas when the recording apparatus is kept on standby, the pressure plate 526 is kept in the rearward position (it is forced to retract rearward and remain there). Therefore, when the recording apparatus is on standby, the recording mediums 524 can be placed on the pressure plate in the feeder tray 527, or removed from the feeder tray 527. When a recording medium 524 is in the feeder tray, its bottom end is in contact with the ribs with which the ASF base 525 is provided.

As for the function of the separation roller 529, even if a plurality of recording mediums 524 happen to enter the nip between the separation roller 529 and feed roller 528 while the recording mediums 524 are fed into the main assembly of the image forming apparatus, the separation roller 529 prevents the recording mediums 524 on the separation roller side from advancing further into the main assembly. With the employment of this structural arrangement, the recording mediums 524 in the automatic sheet feeding portion 517 are fed into the main assembly while being separated one by one. After being fed into the main assembly, each recording medium 524 is sent into the nip between a conveyance roller 502 and a pinch roller 503, which are disposed upstream of the recording area. The conveyance roller 502 is borne by its shaft, and a pair of bearings 512 with which the pair of lateral walls of the chassis 501 are provided one for one. The pinch roller 503 is rotatably supported by the ends of its shaft, being kept pressed upon the conveyance roller 502 by springs.

The conveyance roller 502 is rotationally driven by an unshown LF motor. Each recording medium 524 is conveyed by the rotation of the conveyance roller 509 in the secondary scan direction, that is, the direction intersectional to the primary direction in which the carriage 506 is moved to cause the recording head 508 to scan the recording medium 524. The recording apparatus is provided with a platen 516, which is supported between the pair of lateral walls of the chassis 501, directly facing the surface of the recording head 508, at which the ejection orifices open. Recording is made on the recording medium 524 supported by the platen 516. On the front side of the platen 516, a sheet discharging roller 511 is disposed, upon which a rowel-like wheel 514 is kept pressed by springs. The sheet discharging roller 511 is supported by its shaft and the platen 516, and is driven by the LF motor in synchronism with the driving of the conveyance roller 502. Thus, the recording medium 524 is discharged by the sheet discharging roller 511 and rowel-like wheel 514 into a sheet delivery tray 518 attached to the front of the recording apparatus. The sheet delivery tray 518 extends diagonally up and frontward to a level equal to the level of the top surface of the platen 516 along which the recording medium 524 is conveyed.

In terms of the direction in which the carriage 506 is moved, the left end of the carriage track is the home position of the carriage 506, and the mechanism 515 for recovering the performance of the recording head 508 is disposed below this home position of the carriage 506. The recording head performance recovery mechanism 515 (which hereinafter will be referred to simply as recovery mechanism) is the mechanism for maintaining the performance of the recording head 508, in terms of ink ejection, above a predetermined level, by restoring the performance of the recording head 508. The recovery mechanism 515 has a suction-based performance recovery means which comprises a cap for covering the ejection orifices of the recording head 508 and a vacuum pump for generating negative pressure within the cap. The suction-based recovery means is for unplugging the ejection orifices by removing the debris having entered the ejection orifices, body of ink having increased in viscosity due to the evaporation of its liquid components, bubbles, and the like, from the recording head by suctioning ink, by a predetermined amount, from the recording head through the ejection orifices. The suction-based performance recovery means is also used for completely filling the ejection orifices with ink. The recovery mechanism 515 is also provided with a wiping means for wiping away such unwanted substances such as debris and ink having adhered to the surface of the recording head 508 having the ejection orifices.

The recording unit 520 which supports the carriage 506 in the recording apparatus structured as described above is solidly attached to the bottom case 519, being thereby accurately positioned relative thereto. The automatic sheet feeding portion 517 is solidly attached to the recording unit 520, being thereby precisely positioned relative to the recording unit 520. Also, the platen 516 which supports the conveyance roller 502 and sheet discharging roller 511 is solidly attached to the recording unit 520, being thereby precisely positioned relative thereto.

In the case of the recording apparatus structure in accordance with the prior art, most of the structural components of the recording mechanism, recording medium conveyance mechanism, and recording sheet discharging mechanism are attached to the recording unit 520. Therefore, the chassis 501 of the recording unit 520 is subjected to a large amount of load, since it supports the abovementioned structural components. Thus, insufficiency in the strength and rigidity of the chassis 501 will affect the positional relationship between the recording head 508 and recording medium 524, possibly having an ill effect upon the level of quality at which images are formed. Thus, the chassis 510 needs to be structured so that it is given a substantial amount of strength and rigidity, and this need is one of the causes of the increase in the cost of the recording apparatus.

SUMMARY OF THE INVENTION

The primary object of the present invention is to provide a recording apparatus which is substantially higher in image quality, and lower in cost, than a recording apparatus in accordance with the prior art, by precisely positioning and supporting each of the structural components of a recording apparatus, and reducing thereby the amount of load borne by the chassis of the recording apparatus.

According to an aspect of the present invention, there is provided a recording apparatus for effecting recording on a recording material by recording means, said apparatus comprising a carriage for reciprocal movement while carrying said recording means; a platen for support the recording material at a position opposed to said recording means; feeding roller for feeding the recording material; a pinch roller driven by said feeding roller; a sheet feeding unit for feeding the recording material to the position opposed to the recording means; a recording unit for supporting said carriage and said pinch roller; a base unit supporting said recording unit, said platen, said feeding roller and said sheet feeding unit at respective positions.

These and other objects, features, and advantages of the present invention will become more apparent upon consideration of the following description of the preferred embodiments of the present invention, taken in conjunction with the accompanying drawings.

DETAILED DESCRIPTION OF THE PREFERRED EMBODIMENTS

Figure 1:
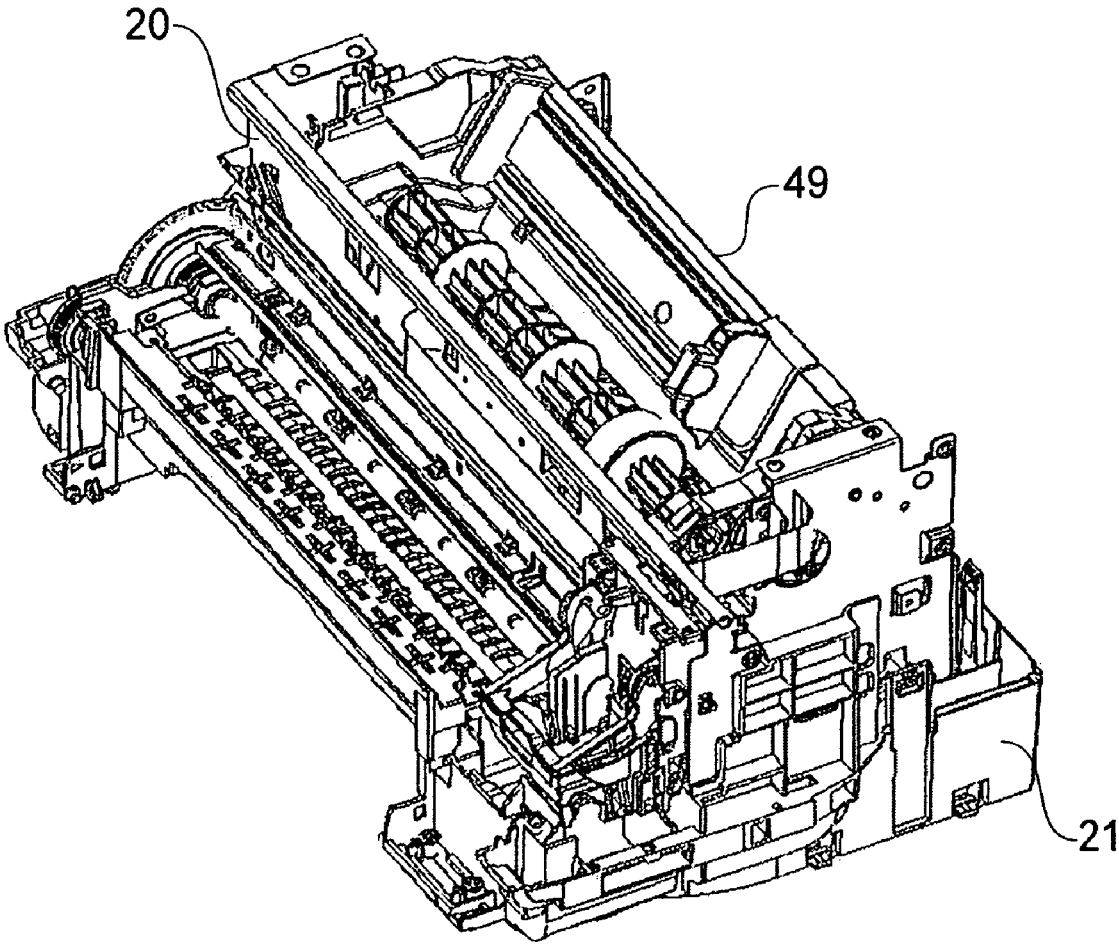
FIG. 1 is a perspective view of the recording unit, sheet feeding unit, and base unit of the recording apparatus in the first embodiment of the present invention, which have been attached to each other.
Figure 2:
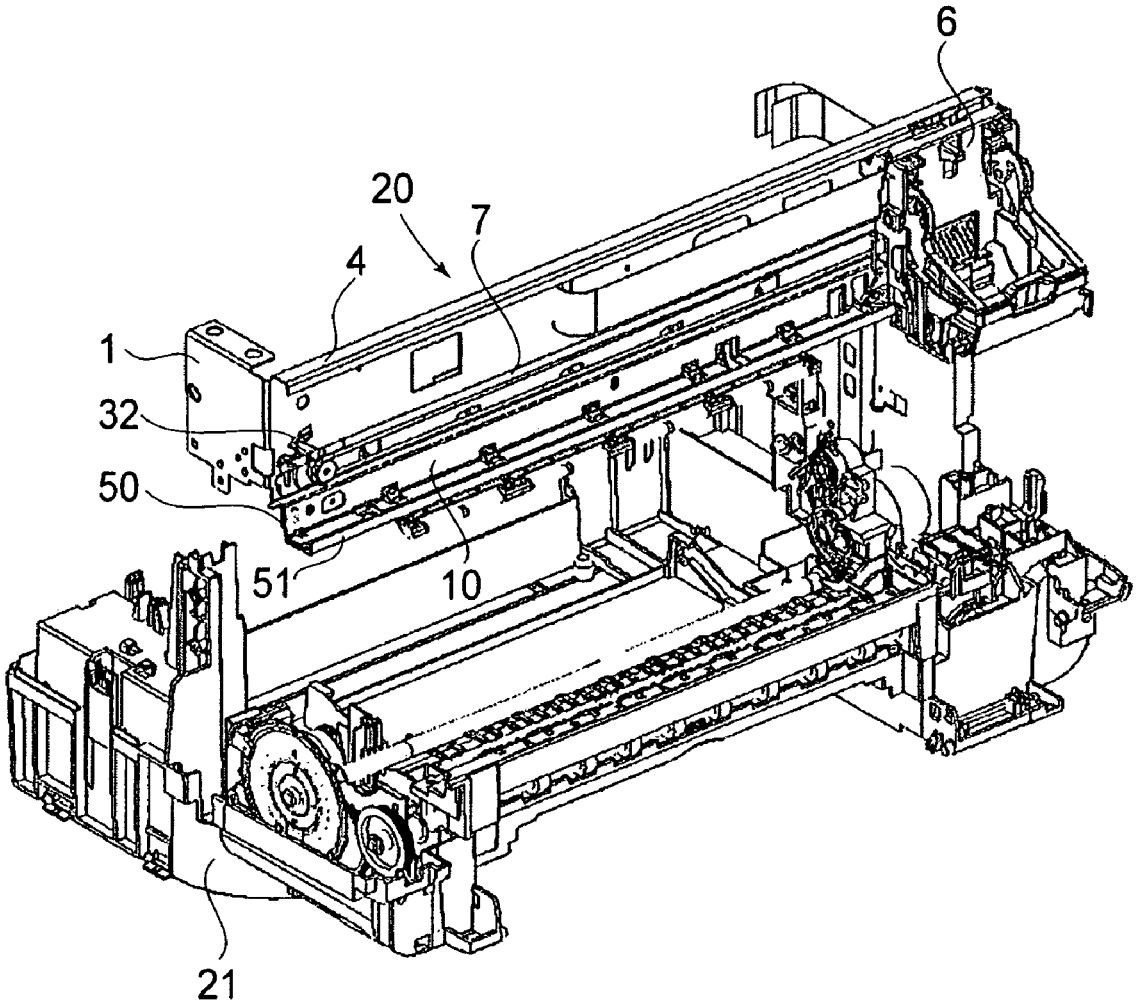
FIG. 2 is a perspective view of the recording unit and base unit of the recording apparatus in the first embodiment of the present invention, shown in FIG. 1, with the recording unit separated from the base units.
Figure 3:
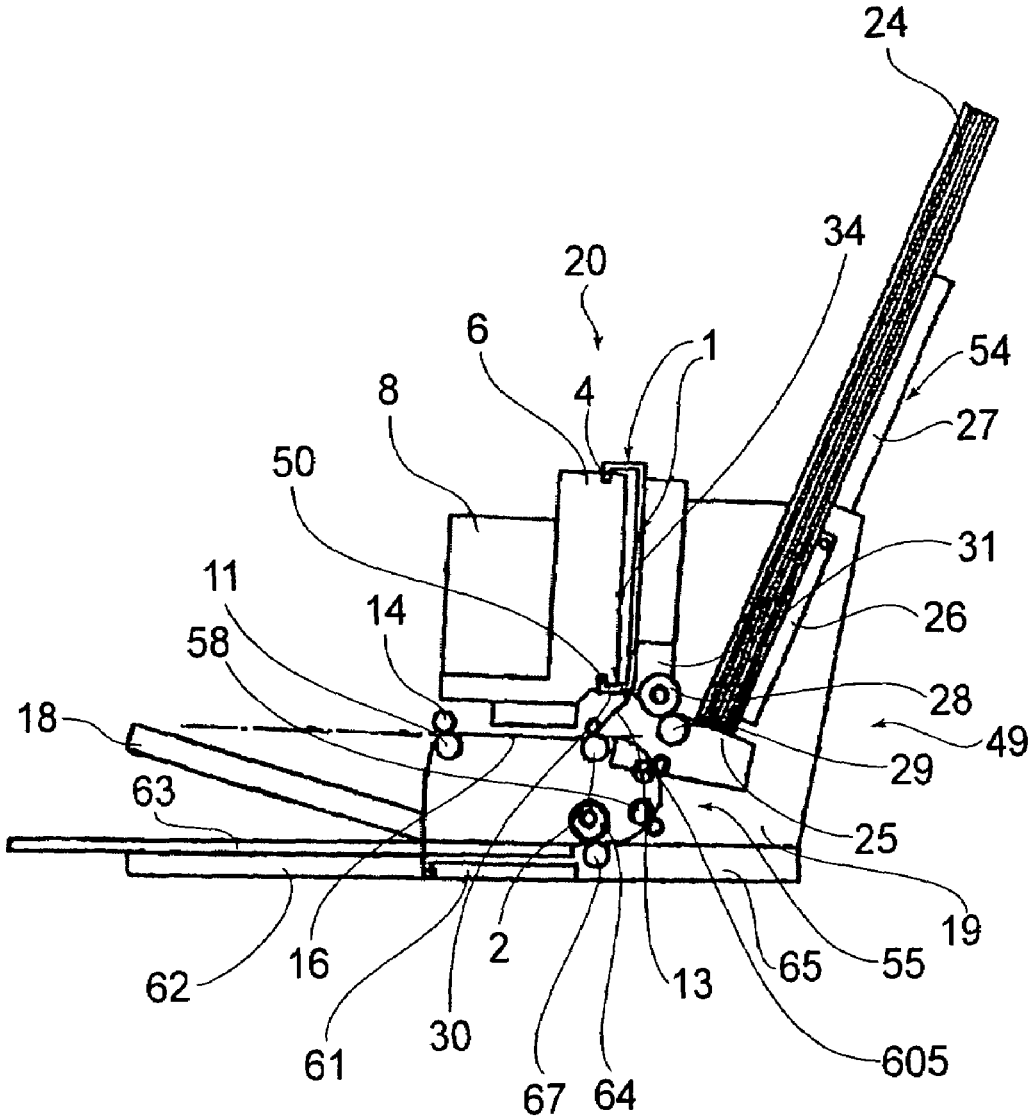
FIG. 3 is a side view of the recording apparatus in the first embodiment of the present invention.
Figure 4:
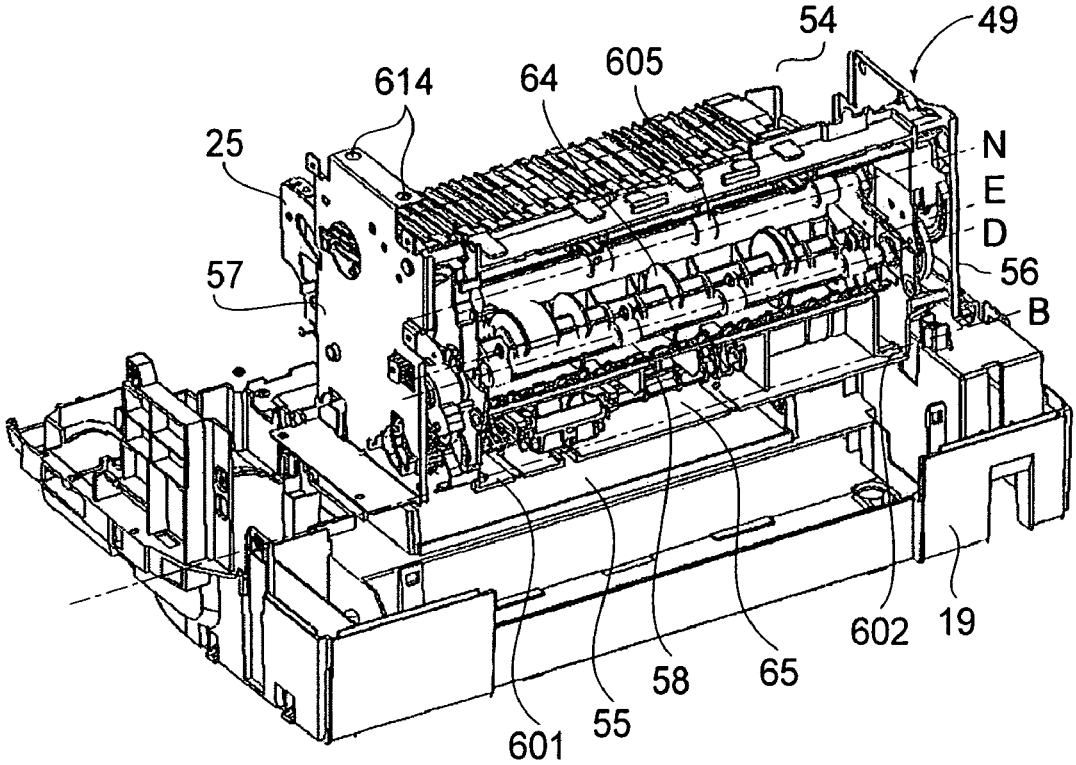
FIG. 4 is a perspective view of the base unit and sheet feeding unit of the recording apparatus in the first embodiment, which have been attached to each other, as seen from the rear side of the apparatus.
Figure 5:
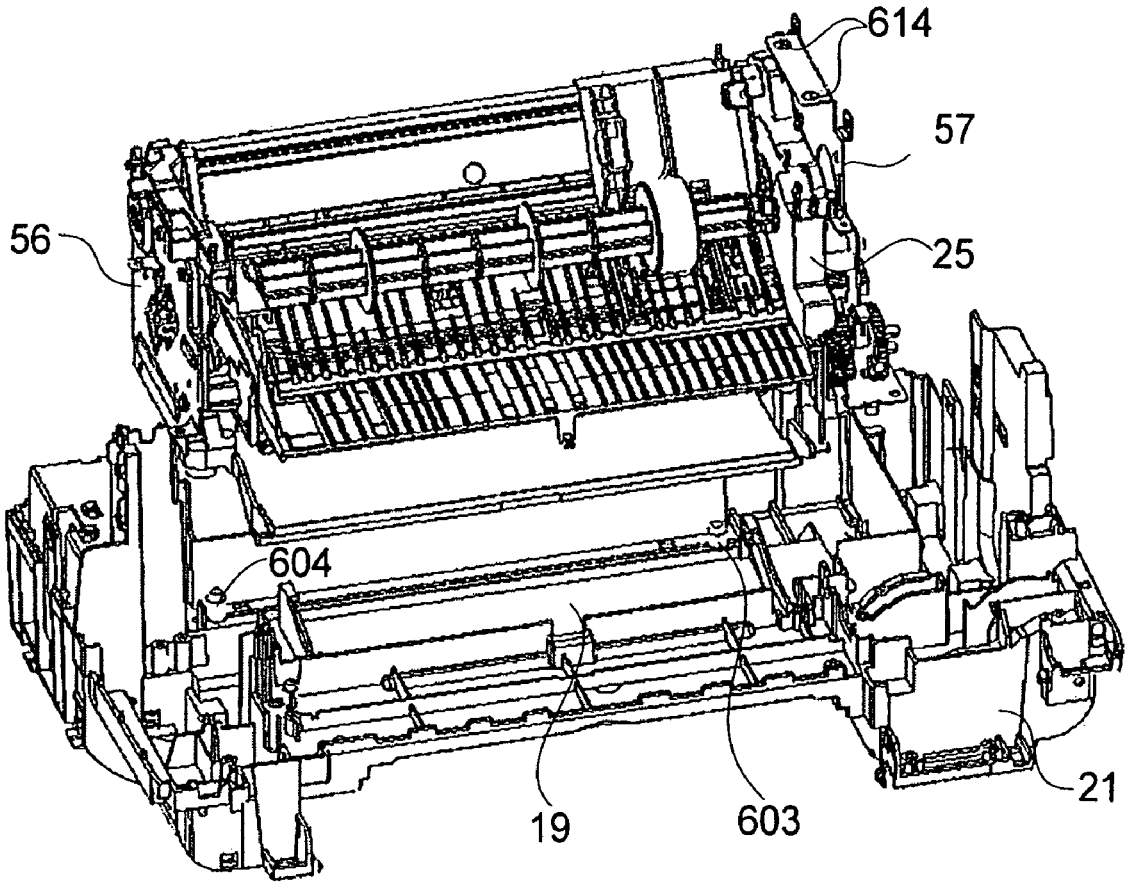
FIG. 5 is a perspective view of the base unit and sheet feeding unit shown in FIG. 4, which have been attached to each other, as seen from the front side of the apparatus.
Figure 6:
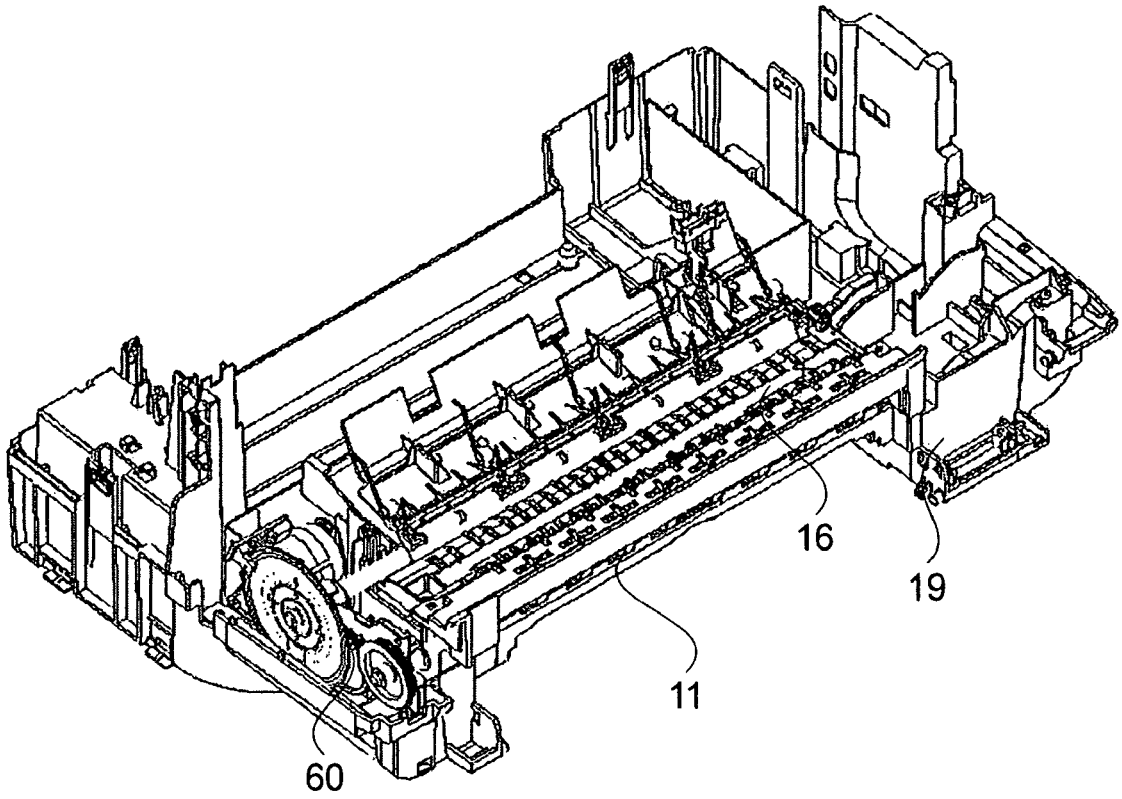
FIG. 6 is a perspective view of the base unit, conveyance roller, and platen of the recording apparatus in the first embodiment of the present invention, which have been attached to each other.
Figure 7:
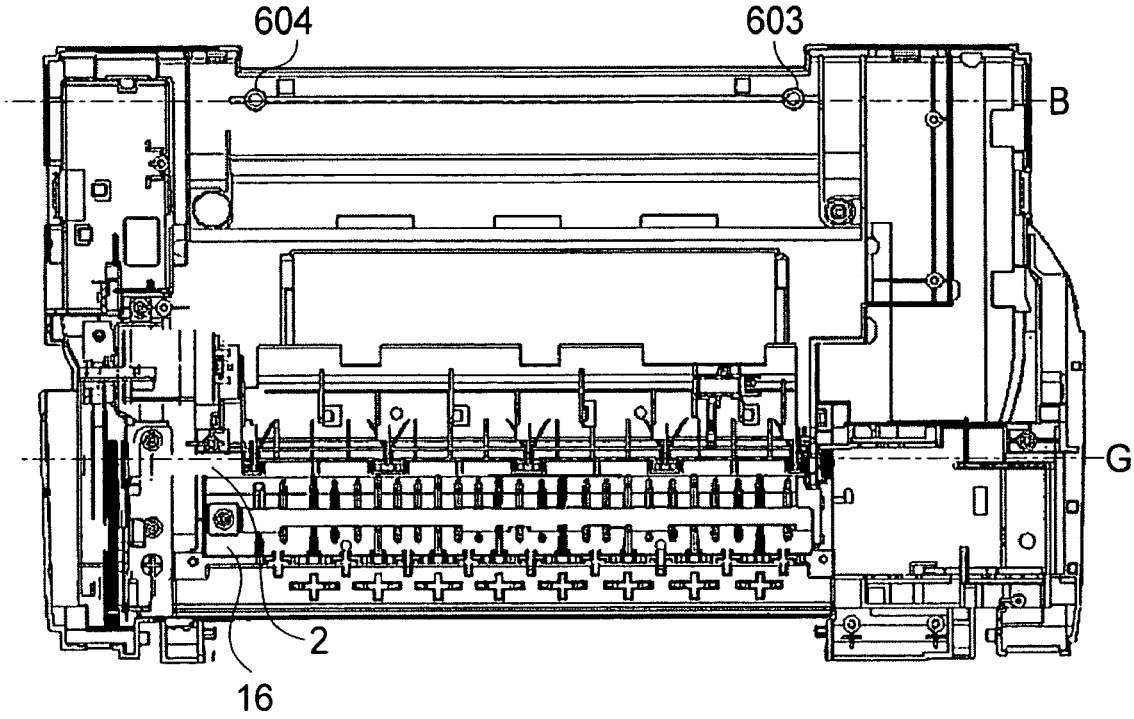
FIG. 7 is a plan view of the base unit, conveyance roller, and platen of the recording apparatus, shown in FIG. 6, which have been attached to each other.

Hereinafter, one of the preferred embodiments of the present invention will be described in detail with reference to the appended drawings. If the referential symbol of a given component in a drawing is identical to that of a component in another drawing, the two components are identical or correspondent to each other. The following embodiment of the present invention will be described with reference to a case in which the recording apparatus is an ink jet recording apparatus. FIG. 1 is a perspective view of the recording unit, sheet feeding unit, and base unit of the recording apparatus in the preferred embodiment of the present invention, which have been attached to each other, and FIG. 2 is a perspective view of the recording unit, sheet feeding unit, and base unit of the recording apparatus in the preferred embodiment of the present invention, which are separated from each other. FIG. 3 is a side view of the recording apparatus in the preferred embodiment of the present invention, and FIG. 4 is a perspective view of the base unit and sheet feeding unit of the recording apparatus in the preferred embodiment, which have been attached to each other, as seen from the rear side of the apparatus. FIG. 5 is a perspective view of the base unit and sheet feeding unit shown in FIG. 4, which have been attached to each other, as seen from the front side of the apparatus. FIG. 6 is a perspective view of the base unit, conveyance roller, and platen of the recording apparatus in the preferred embodiment of the present invention, which have been attached to each other. FIG. 7 is a plan view of the base unit, conveyance roller, and platen shown in FIG. 6, which have been attached to each other.

Figure 8:
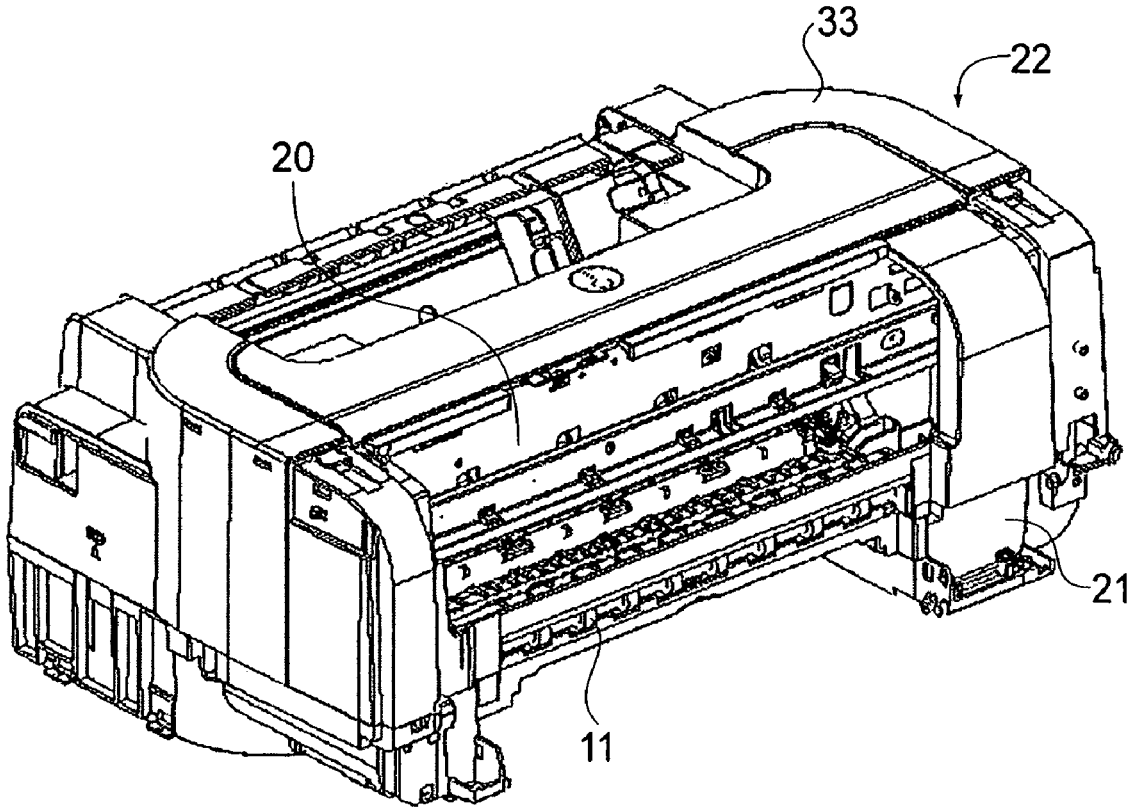
FIG. 8 is a perspective view of the recording unit, base unit, and main case unit of the recording apparatus in the first embodiment of the present invention, which have been attached to each other.
Figure 9:
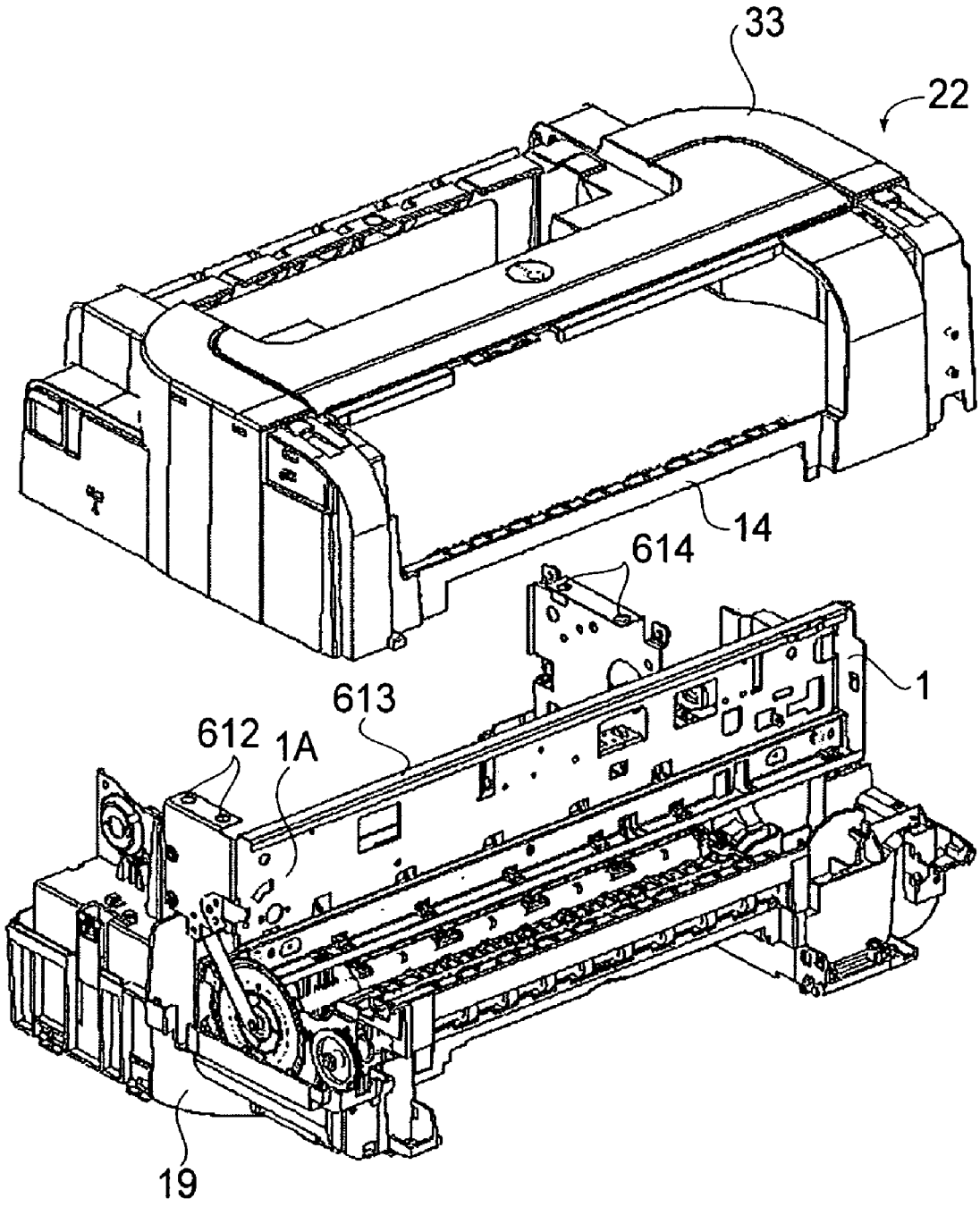
FIG. 9 is a perspective view of the recording unit, base unit, and main case unit of the recording apparatus shown in FIG. 8, with the main case unit separated from the other two.
Figure 10:
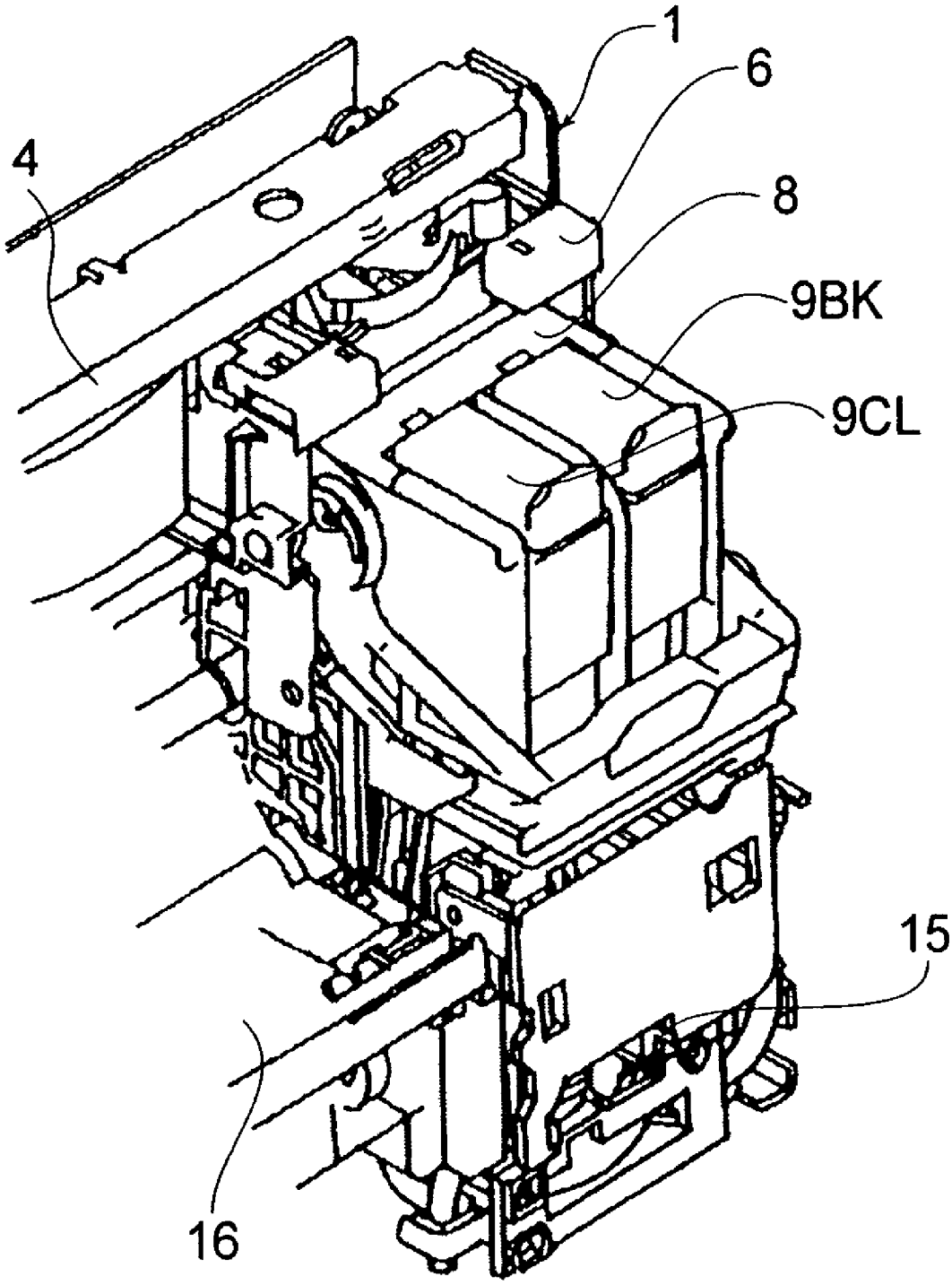
FIG. 10 is a perspective view of the left end portion of the recording apparatus shown in FIG. 1, in which the carriage, which is holding the recording head and an ink container, is in its home position.
Figure 11:
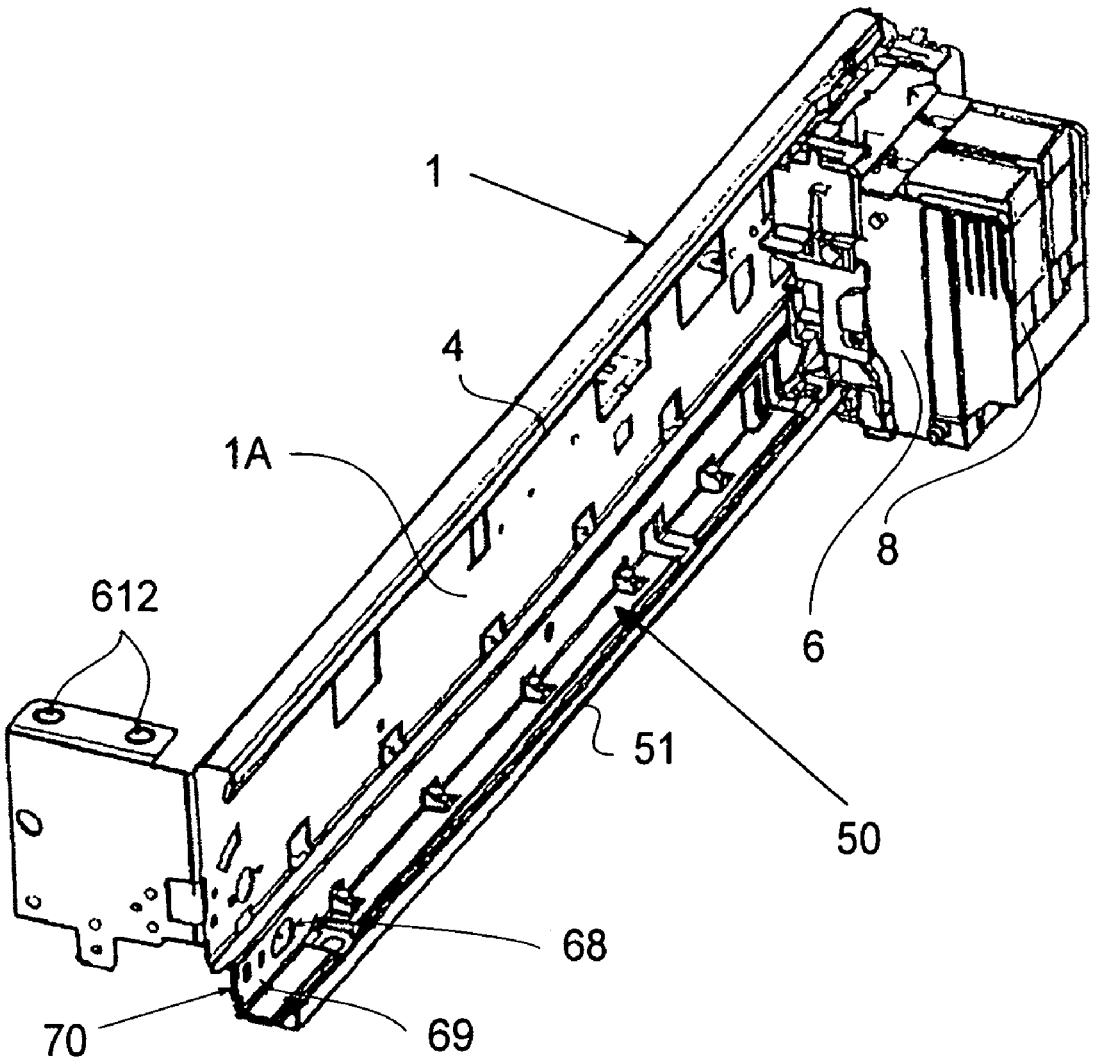
FIG. 11 is a perspective view of the recording gap adjustment mechanism of the recording unit of the recording apparatus shown in FIG. 1.
Figure 12:
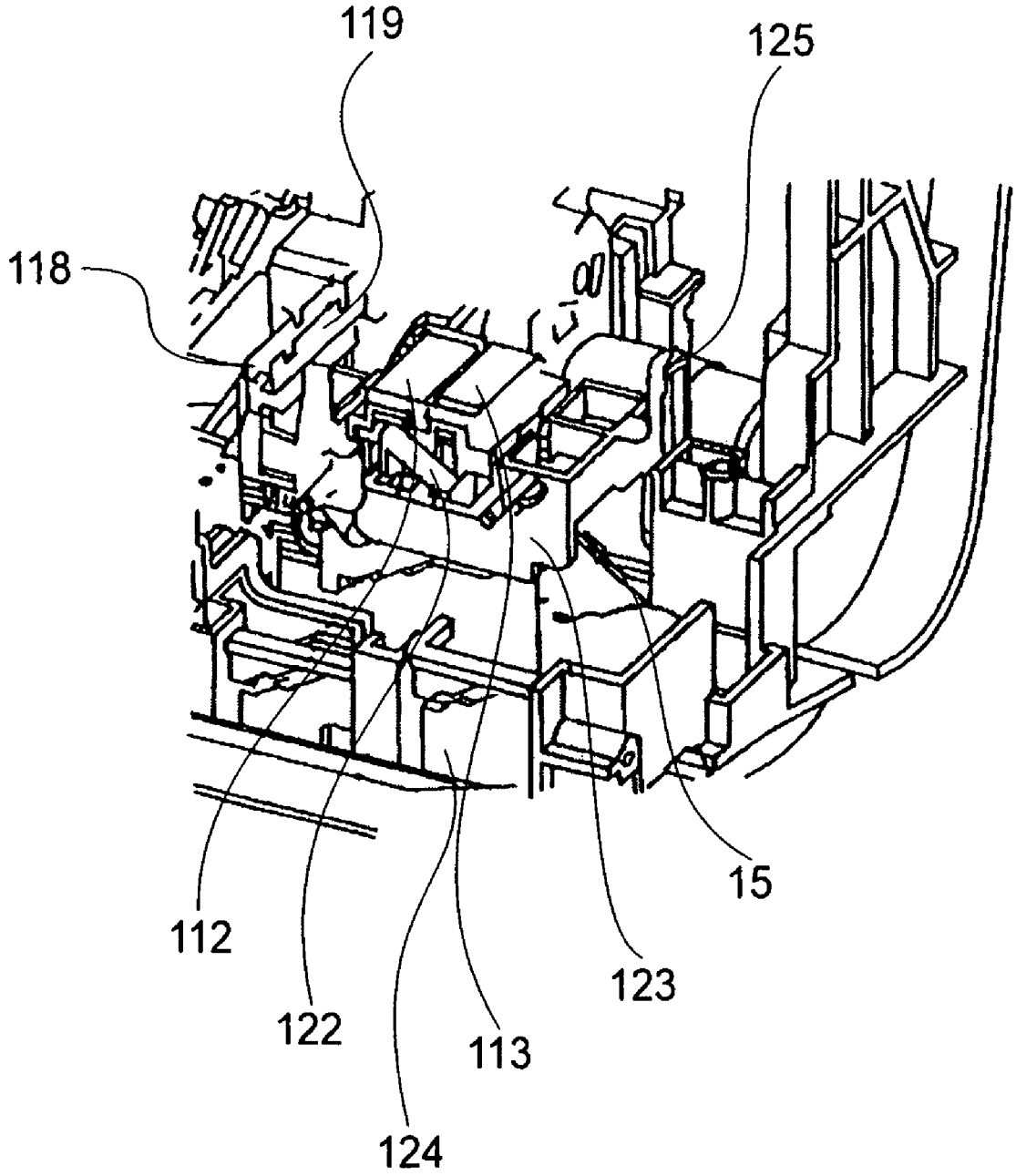
FIG. 12 is a perspective view of the recording performance recovery mechanism portion of the recording apparatus shown in FIG. 1, showing the structure thereof.
Figure 13:
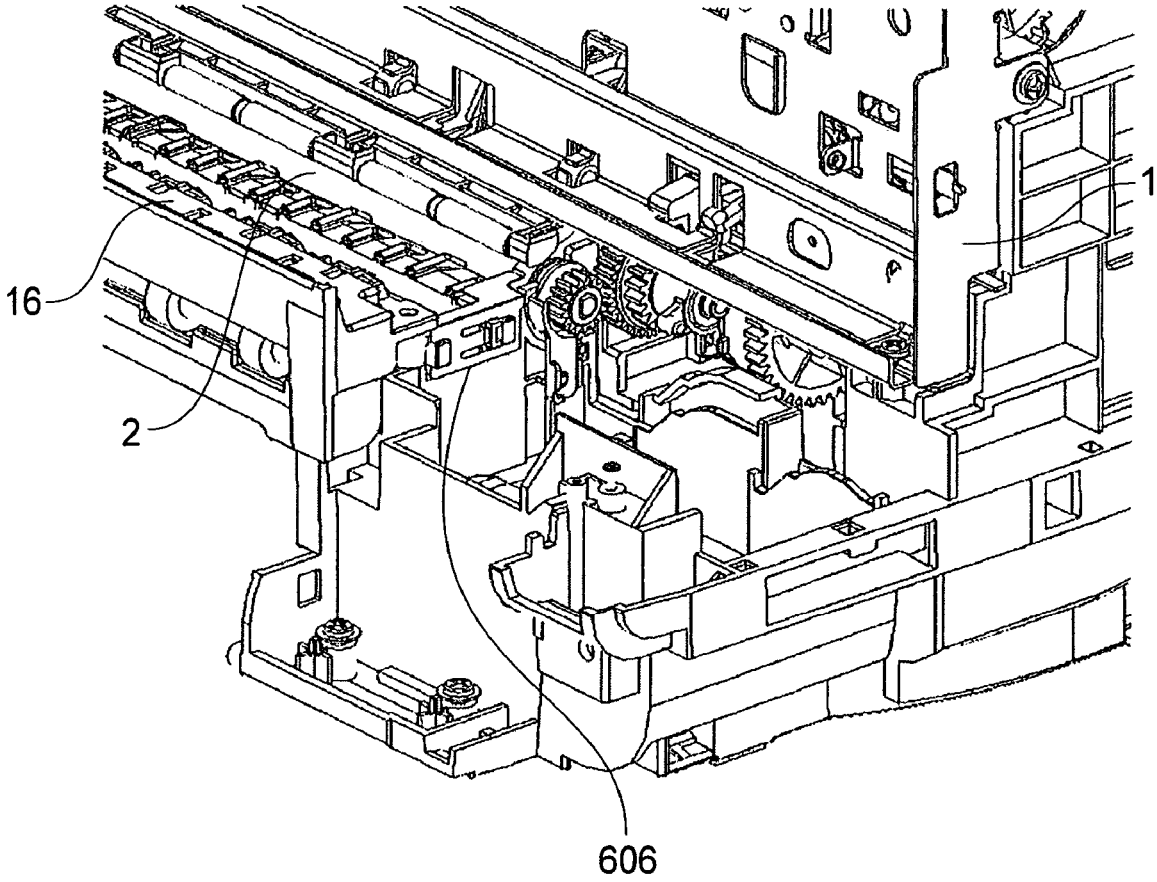
FIG. 13 is a perspective view of the driving system for driving the sheet conveyance mechanism and performance recovery mechanism of the recording apparatus in the first embodiment of the present invention.
Figure 14:
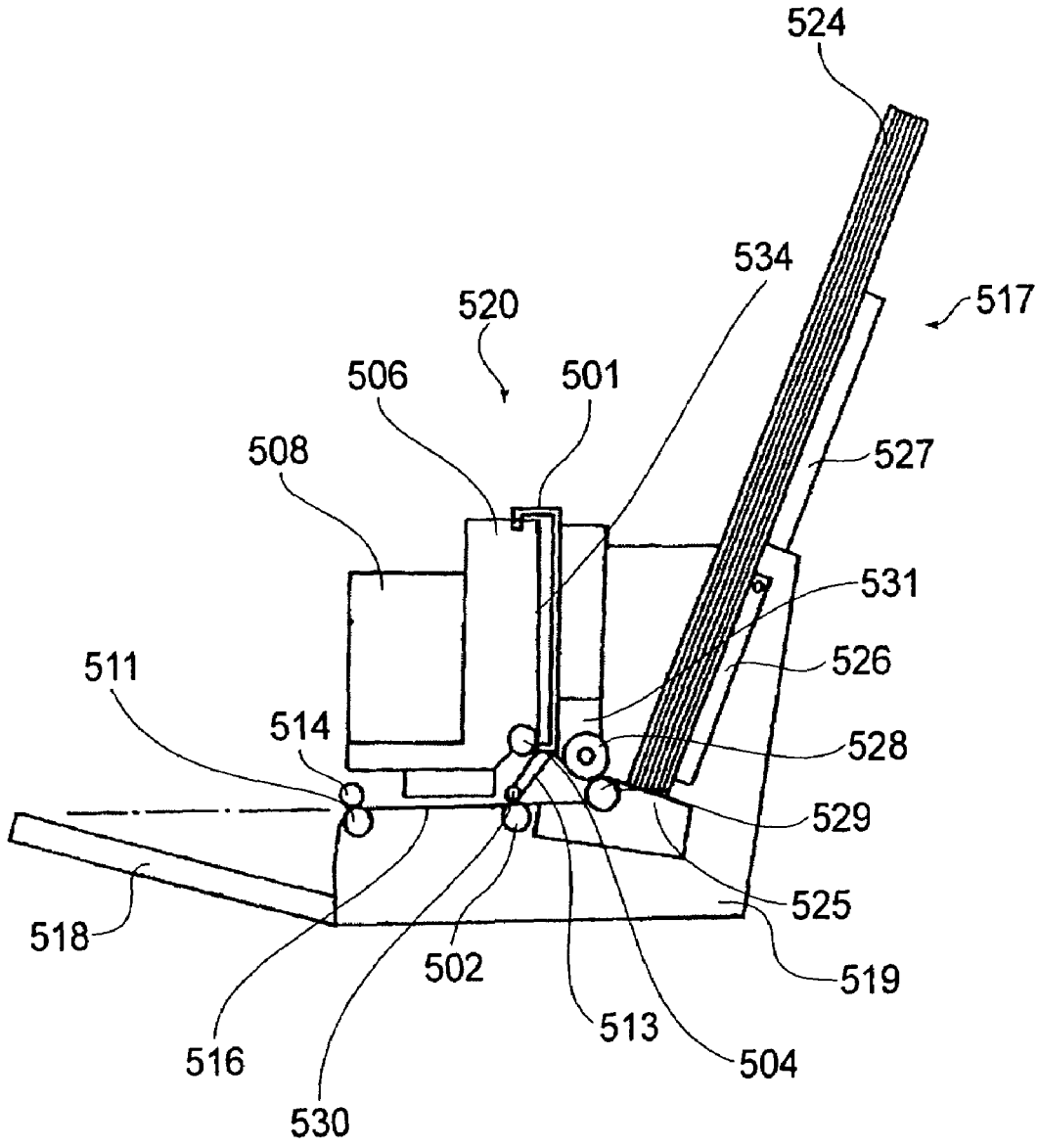
FIG. 14 is a side view of a typical recording apparatus in accordance with the prior art.
Figure 15:
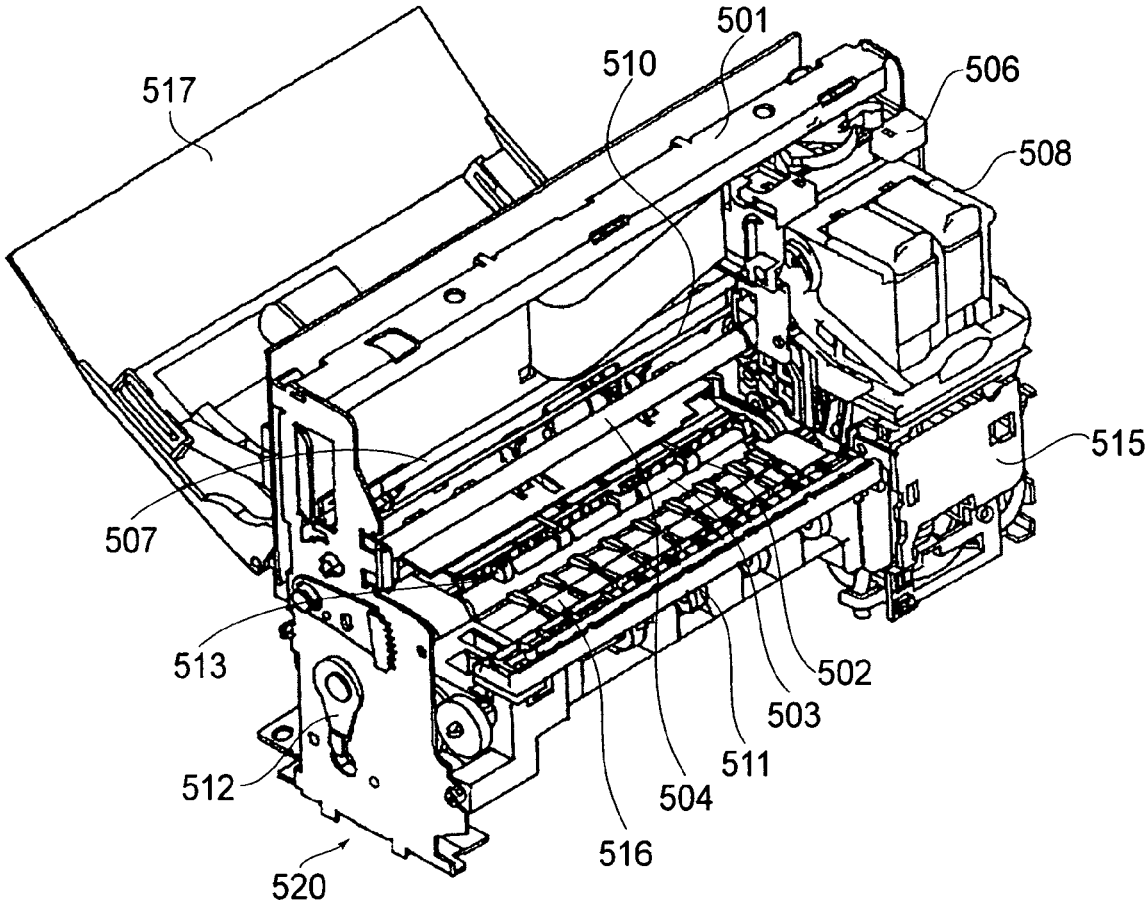
FIG. 15 is a perspective view of the typical recording apparatus in accordance with the prior art.

FIG. 8 is a perspective view of the recording unit, base unit, and main case unit of the recording apparatus in the preferred embodiment of the present invention, which are attached to each other, and FIG. 9 is a perspective view of the recording unit, base unit and main case unit of the recording apparatus, shown in FIG. 8, with the recording unit and base unit attached to each other, and the main case unit separated from the preceding two units. FIG. 10 is a perspective view of the left end portion of the recording apparatus shown in FIG. 1, in which the carriage, which is holding the recording means and an ink container, is in its home position, and FIG. 11 is a perspective view of the recording gap adjustment mechanism of the recording unit of the recording apparatus shown in FIG. 1. FIG. 12 is a schematic perspective view of the recording performance recovery mechanism portion of the recording apparatus shown in FIG. 1, showing the structure thereof, and FIG. 13 is a perspective view of the driving system for driving the sheet conveyance mechanism and performance recovery mechanism of the recording apparatus in the preferred embodiment of the present invention.

Referring to FIGS. 1-13, the recording apparatus in the preferred embodiment of the present invention essentially comprises a recording unit 20, a base unit 21, a sheet feeding unit 49, and a main case unit 22. These structural components are attached to each other, being thereby precisely positioned relative to each other, with the use of connective means such as small screws, and positioning means as shafts and holes for precisely positioning them relative to each other. FIG. 1 shows the recording unit 20, sheet feeding unit 49, and base unit 21, which have been attached to each other, whereas FIG. 2 shows the recording unit 20, and base unit 21, which have been separated from each other. FIG. 3 is a side view of the recording apparatus shown in FIG. 2, showing the structure thereof. In the following description of the preferred embodiment of the present invention, the portion of the recording apparatus having a sheet delivery tray 18 is referred to as front side, and the left side of the apparatus as seen from the front side will be referred to as left side of the apparatus.

Referring to FIG. 2, the recording unit 20 is provided with a chassis 1, which is formed of a piece of plate, and has the rear wall portion, which is vertical. The chassis 1 has the top wall portion, left wall portion, and right wall portion, which perpendicularly extend frontward from the rear wall portion, giving the chassis 1 a boxy shape. The recording unit 20 is provided with a rail 50, which is attached to one of the bottom edges of the chassis 1, and is roughly L-shaped in cross section, being positioned so that its portion corresponding to the bottom stroke of L becomes horizontal. The rail 50 is solidly attached to the predetermined portion of the recording unit 20 with the use of small screws or the like, although it can be vertically moved by loosening the small screws or the like. The top edge portion of the chassis 1, and the bottom side of the rail 50, that is, the horizontal portion of the rail 50, constitute the guide portions 4 and 51, respectively, which guide the carriage 6. More specifically, the carriage 6 is provided with engaging portions 52 and 53, which are attached to the top and bottom ends of the carriage 6, and engage with the guide portions 4 and 51, respectively. Thus, the carriage 6 is supported by the guide portions 4 and 51, so that the carriage 6 is allowed to slide on the guide portions 4 and 51 in both the right and left directions, with the engaging portions 52 and 53 remaining engaged with the guide portions 4 and 51, respectively.

The carriage 6 is capable of holding the recording head 8 as a recording means. The distance (recording gap) between the surface of the recording head 8, at which the ejection orifices open, and the recording surface of the recording medium, can be set to a desired value by moving the rail 50 in the direction roughly perpendicular to recording surface of the recording medium, so that the distance becomes the desired value, before tightening the aforementioned small screws or the like means for fastening the rail 50. The smaller the recording gap, the more stable the relationship between a point of the recording surface of the recording medium, on which a given droplet of ink is expected to land, and the actual point on which the given droplet of ink lands, and therefore, the higher the level of quality at which recording is made. However, if the recording gap is smaller than a certain value, the recording head sometimes rubs against the recording medium, resulting in the formation of an image soiled with ink. In other words, it is necessary to control the recording gap in order to yield high quality images.

The rail 50 is movable by placing an unshown pair of eccentric cams as rail moving means in contact with the left and right cam follower portions 68 of the rail 50. For example, as the pair of eccentric cams are rotated in the clockwise direction, the rail 50 is moved away from the recording surface of the recording medium, whereas as the pair of eccentric cams are rotated in the counterclockwise direction, the rail 50 is moved toward the recording surface of the recording medium. In other words, the rail 50 is vertically movable relative to the recording medium while remaining in the same position in terms of the direction parallel to the direction in which the carriage 6 is reciprocally movable. Incidentally, an experienced operator may be allowed to manually move the handhold portions 70 located at the left and right ends of the rail 50, one for one, in order to adjust the recording gap.

To the carriage 6, an endless driving belt 10 is connected, which is stretched around the pair of pulleys rotatably supported by their shafts, by the left and right end portions of the front side of the rear wall of the chassis 1. The pulleys and driving belt 10 are toothed so that their teeth mesh with each other. The pulley on the right-hand side is kept pressured rightward so that the driving belt 10 will be provided with a predetermined amount of tension. The pulley on the left-hand side is solidly fixed to the output shaft of the carriage motor 104. Thus, as the carriage motor 104 is driven, the driving force from the motor 104 is transmitted to the carriage 6 through the pulleys and driving belt 10, causing the carriage 6 to reciprocally move.

On the left side of the left pulley, a belt stopper 32 is disposed, which surrounds the peripheral surface of the left pulley, with the presence of a predetermined distance between the peripheral surface of the left pulley and belt stopper 32. The belt stopper 32 extends frontward from the chassis 1, and prevents the jumping of the driving belt 10, that is, the phenomenon (problem) that when the carriage 6 is overloaded, the teeth of the driving belt 10 are disengaged from the teeth of one or both of the pulleys in the radius direction of the pulleys, and slips. This belt stopper 32 is structured so that as the carriage 6 overruns leftward, the belt stopper 32 comes into contact with a part of the carriage 6. In other words, the belt stopper 32 functions also as a stopper for preventing the carriage 6 from moving out of the predetermined primary scan range.

FIG. 10 is a perspective view of the right-hand end portion of the of the recording apparatus shown in FIG. 1, in which the carriage is in its home position. The recording head 8 is mounted on the carriage 6. The recording head 8 has a plurality of electro-thermal transducing members as the elements for generating thermal energy, and a plurality of liquid passages (nozzles) which lead to the plurality of liquid ejection orifices, and in which the electro-thermal transducing elements are disposed one for one. Thus, as thermal energy is generated by the electro-thermal transducing element in any of the liquid passages, bubbles are generated in the liquid (liquid is boiled in the so-called film boiling fashion) in the liquid passage. As the bubbles grow and contract, the resultant changes in the internal pressure of the liquid passage causes the liquid in the liquid passage to eject through the liquid ejection orifices.

In this embodiment, the home position of the carriage 6 is located in the right-hand end of the recording apparatus. To the recording head 8, a black (BK) ink container 9BK, and a color (CL) ink container 9CL are attached. The ink container which is farther from the recording area when the carriage 6 is in its home position is the black ink container 9BK.

The recording head 8 is provided with a set of wires and connectors which are connected to the plurality of electro-thermal transducing elements, one for one. The wires are connected to the carriage 6 through these connectors, establishing thereby electrical connection between the recording head 8 and the main assembly of the recording apparatus. On the rear surface of the carriage 6, a substrate 34, which holds the circuit for controlling the operation of the recording head 8, is attached, being connected to the main assembly of the recording apparatus through a flexible cable.

Disposed on the front surface of the rear wall 1A of the chassis 1 is an encoder 7, which is used, in combination with the sensor disposed on the substrate 34 of the carriage 6, to detect the position of the carriage 6. The signals which indicate the position of the carriage 6 detected as described above are used for controlling the movements of the carriage 6 and operation of the recording head 8. The encoder 7 is kept pressured leftward. In the bottom portion of the chassis 1, a pinch roller holder 13, which rotatably supports a pinch roller 3 by the shaft of the pinch roller, by one end, is supported by the other end of the pinch roller holder 13, by the chassis 1. The pinch roller 13 is kept pressured downward.

The base unit 21 has a base member 19. The surface of the recording apparatus, by which the recording apparatus is supported when the recording apparatus is normally position on a desk or the like, is the bottom surface of the base member 19. On the rear edge portion of the base member 19, the sheet feeding unit 49 is disposed, being precisely positioned relative to the main assembly of the recording apparatus. The sheet feeding unit 49 is provided with an ASF unit 54 as the primary sheet feeding unit, and a PF unit 55 as the secondary sheet feeding unit. The ASF unit 54 and PF unit 55 are precisely positioned relative to the main assembly by the pair of lateral plates of the chassis 1, that is, the L lateral plate 56 and R lateral plate 57 of the chassis 1, with the shafts engaged into the holes. Further, the shafts of the base member 19 are fitted one for one in the holes of the PF base 65 of the PF unit 55, positioning thereby the sheet feeding unit 49 in parallel to the conveyance roller 2. Here, that the sheet feeding unit 49 is parallel to the conveyance roller 2 means that the sheet feeding unit 49 is perpendicular to the recording medium conveyance direction.

To the left surface of the ASF unit 54 and the left surface of the PF unit 55, the L lateral portion 56 of the chassis 1 is solidly attached with the use of small screws, being thereby precisely positioned relative to the PF base 65. The ASF base 25 is precisely positioned relative to the L lateral portion 56 of the chassis 1. The ASF base 25 is not solidly attached to the L lateral portion 56 (it is not attached with small screws). To the right surface of the ASF unit 54 and the right surface of the PF unit 55, the R lateral portion 57 of the chassis 1 is solidly attached with the use of small screws, being thereby precisely positioned relative to the PF base 65. The ASF base 25 is attached to the R lateral portion 57 of the chassis 1 also with the use of small screws.

Referring to FIG. 4, the bottom surface of the PF base 65 is provided with a hole 601 and an elongated hole 602, which are used for precisely positioning the PF base 65 relative to the base 19. Next, referring to FIG. 5, the base 19 is provided with bosses 603 and 604, which are positioned so that the straight line B connecting the centers of the two bosses 603 and 604 becomes perpendicular to the recording medium conveyance direction. Referring to FIG. 7, the level of parallelism between the straight line B which coincides with the centers of the bosses 603 and 604 (axial line of PF base 65), and the axial line G of the conveyance roller 2, which will be described later, is controlled to be no more than 0.1 degrees. Referring again to FIGS. 4 and 5, a first intermediate roller 58, a second intermediate roller 605, and a PF roller 64 are rotatably supported by their shafts, by the PF base 65. The level of parallelism between the axial line B of the PF base 65 and the axial line N of the second intermediate roller 605, the level of parallelism between the axial line N of the second intermediate roller 605 and the axial line D of the first intermediate roller 58, and the level of parallelism between the axial line N of the second intermediate roller 605 and the axial line E of the PF roller 64, are controlled to be no more than 0.1 degrees.

The level of perpendicularity of the rotational axis of the PF base 65 relative to the recording medium conveyance direction, and the level of perpendicularity of the rotational axis of the ASF base 25 relative to the recording medium conveyance direction, are controlled with the use of the L and R lateral portions 56 and 57, respectively, of the chassis 1. The level of parallelism between the rotational axis B of the PF base 65 and the axial line F of an ASF roller 28 supported by its shaft and the ASF base 25, is controlled to fall within a predetermined range. The ASF unit 54 is provided with an ASF pressure plate 26 and ASF tray 27, which are disposed so that they extend up and rearward. Against the combination of the ASF pressure plate 26 and ASF tray 27, a plurality of recording mediums 24 are rested in layers. The ASF pressure plate 26 is attached to the ASF base 25 so that the ASF pressure plate 26 can be pivoted about the top edge portion of the ASF pressure plate 26. The bottom edge portion of the ASF pressure plate 26 is kept pressured frontward (clockwise direction in FIG. 3) by unshown springs.

The first feed roller 28 is (ASF roller) positioned so that the bottom portions of the recording mediums 24 resting against the ASF pressure plate 26 are pressed against the first feed roller 28 by the ASF pressure plate 26, which is kept pressured by the unshown springs as described above. The ASF roller 28 is supported by the lengthwise ends of its shaft, by the first base 25 (ASF base). The ASF roller 28 is provided with an ASF roller gear 30 (FIG. 2), which is attached to one of the lengthwise ends of the shafts of the ASF roller 28. The ASF roller gear 30 is connected to the rotational shaft of the first intermediate roller 58 (which will be described later), with the interposition of gears or the like, and is rotationally driven by the PF motor 59 for driving the first intermediate roller 58. An ASF separation roller 29 (FIG. 3) is positioned so that it opposes the ASF roller 28, being kept pressured upon the ASF roller 28 by unshown pressure generating means.

As a recording operation is started, the ASF roller 28 is rotationally driven to convey the recording medium 24. The ASF portion is structured so that the ASF pressure roller 26 is moved, in coordination with the rotation of the ASF roller 28, by the unshown control cam (unshown) supported by its shaft and the ASF base 25. With the provision of this structural arrangement, when it is the time to feed the main assembly of the recording apparatus with the recording medium 24, the ASF pressure plate 26 is moved to press the recording medium 24 upon the ASF roller 28, whereas when it is unnecessary to feed the main assembly with the recording medium 24, the ASF pressure plate 26 is pivoted against the pressure from the abovementioned springs so that the bottom portion thereof will be moved rearward, away from the recording medium 24 (it is moved back into standby position). Thus, when the ASF pressure plate 26 is in the standby position, the recording medium 24 can be easily placed on, or removed from, the ASF pressure plate 26. When the recording medium 24 is in the ASF tray 27, the leading edge of the recording medium 24 remains in contact with the ribs with which the ASF base 25 is provided.

Regarding the function of the ASF separation roller 29, if a plurality of recording mediums 24 happen to enter the nip between the ASF separation roller 29 and ASF roller 28 while the recording mediums 24 are fed into the main assembly of the image forming apparatus, the ASF separation roller 29 prevents the recording mediums 24 on the ASF separation roller side from advancing further into the main assembly. With the employment of this structural arrangement, the recording mediums 24 are fed into the main assembly while being separated one by one. The ASF base 25, ASF pressure plate 26, ASF roller 28, ASF separation roller 29, etc., make up the ASF unit 54 as the first sheet feeding unit.

Next, referring primarily to FIG. 3, the PF unit 55 as the second sheet feeding unit will be described. To the base unit 21, the PF pressure plate 61 and PF tray 62 are attached, being thereby positioned roughly parallel to the bottom surface of the base unit 21. It is on the combination of the PF pressure plate 61 and PF feeder tray 62 that a plurality of recording mediums 63 are placed. The PF pressure plate 61 is attached to the base 19, being enabled to pivot about the front edge portion of the PF pressure plate 61, with the rear end portion of the PF pressure plate 61 being kept pressured upward (counterclockwise direction in FIG. 3) by the unshown springs. The PF roller 64 as the second sheet feeding roller is positioned so that the leading edge portion of the top recording medium 63 in the PF feeder tray 62 is pressed on the PF roller 64 by the PF pressure plate 61, which is kept pivotally pressured as described above.

The PF roller 64 is supported at the lengthwise ends of its shaft, by the second base 65 (PF base). The PF roller 64 is provided with a PF roller gear 66, which is attached to one of the lengthwise ends of the shafts of the PF roller 64. The PF roller gear 66 is connected to the rotational shaft of the first intermediate roller 58 located downstream of the PF roller 64 in terms of the recording medium conveyance direction, with the interposition of gears or the like, and is rotationally driven by the PF motor 59 for driving the first intermediate roller 58. On the downstream side of the first intermediate roller 58 in terms of the recording medium conveyance direction, the second intermediate roller 605 is disposed. Within the PF unit 55, a U-turn conveyance passage is provided, which not only places the recording medium 63 upside down, but also, reverses the recording medium 63 in terms of the conveyance direction.

The PF unit is provided with a PF separation roller 67, which is disposed in a manner to oppose the PF roller 64. The PF separation roller 67 is kept pressed upon the PF roller 64 by the unshown pressing means. As a recording operation is started, the PF roller is rotationally driven, conveying thereby the recording medium 63. The PF pressure plate 61 is supported by its shaft and the PF base 65, and its pivotal movement is controlled by the unshown control cam in coordination with the rotation of the PF roller 64. With the provision of this structural arrangement, when it is necessary for the recording medium 63 to be fed, the PF pressure plate 61 is caused to press the recording medium 63 upon the PF roller 64, whereas when it is unnecessary for the PF pressure plate 61 to press the recording medium 64, the PF pressure plate 61 is pivoted against the pressure from the abovementioned springs so that its bottom portion is moved downward (the PF pressure plate 61 is pushed back into the standby position).

Thus, when the PF pressure plate 61 is in the standby position, the recording medium 63 can be easily placed on, or removed from, the PF pressure plate 61. When the recording medium 63 is in the PF tray 62, its leading edge remains in contact with the ribs with which the PF base 65 is provided. If a plurality of recording mediums 63 happen to enter the nip between the PF separation roller 67 and PF roller 64 while the recording mediums 24 are fed into the main assembly of the image forming apparatus, the PF separation roller 67 prevents the recording mediums 63 on the PF separation roller side from advancing further into the main assembly. The PF base 65, PF roller 64, PF pressure plate 61, PF separation roller 67, first and second intermediate rollers 58 and 608, respectively, etc., make up the PF unit 55 as the second sheet feeding unit.

The conveyance roller 2 is positioned so that, as the recording medium 24 or 63 is fed into the main assembly of the recording apparatus by the ASF unit 54 or PF unit 55, respectively, the leading edge of the recording medium 24 or 63 reaches the conveyance roller 2. The conveyance roller 2 is rotatably supported by its shaft, and the LF chassis 60, one end of which is supported by its shaft and the base 19, and the other end of which is solidly fixed to the base 19, being thereby precisely positioned relative to the base 19. The conveyance roller 2 is provided with an LF gear 36, which is attached to one of the lengthwise ends of the conveyance roller 2. The conveyance roller 2 is rotationally driven by an LF motor 35 (conveyance motor), through this LF gear 36. The conveyance roller 2 is supported by the LF chassis 60, which is precisely positioned relative to the base unit 21 in order to ensure the abovementioned structural components are positioned in parallel, and the portions of the LF chassis 60, which support the conveyance roller 2, the portions of the LF chassis 60, to which the base unit 21 is attached, and the portions of the base unit 21, which support the conveyance roller 2, are aligned in the direction perpendicular to the recording conveyance direction.

The pinch roller 3 attached to the bottom edge portion of the chassis 1 is placed in contact with the conveyance roller 2. After the recording medium 24 or 63 is fed into the main assembly of the recording apparatus, its leading edge portion is pinched between the conveyance roller 2 and pinch roller 3. In the main assembly, the recording head 8 is on the reciprocally movable carriage 6, and the platen 16 is disposed so that it directly faces the surface of the recording head 8, at which the ejection orifices open. On the downstream side of the platen 16, the sheet discharging roller 11 is disposed. The sheet discharging roller 11 is rotatably supported by the platen 16 and LF chassis 60; one end of the shaft of the sheet discharging roller 11 is supported by the platen 16, and the other end is supported by the LF chassis 60. Referring to FIGS. 8 and 9, the rowel-like wheel 14 kept pressed on the sheet discharging roller 11 is supported by its shaft and the main case unit 22.

The sheet discharging roller 11, the one end of which is supported by the LF chassis 60, and the other end of which is supported by the platen 16, is connected to the shaft of the conveyance roller 2, with the interposition of the idler gear 23 (FIG. 2), and is rotationally driven by the rotation of the conveyance roller 2. The unshown mechanical power source for driving the conveyance roller 2, idler gear 23, and sheet discharging roller 11 is precisely supported by the LF chassis 60, which is one of the lateral portions of a single piece of plate. This unshown mechanical power source is a part of the conveyance chassis unit. The above described structural arrangement contributes to the improvement of the level of accuracy at which the recording mediums are conveyed.

The platen 16 is provided with a sheet pressing plate 606 for preventing the portion of the recording medium located next to the referential portion for aligning (precisely positioning) the recording mediums, from rising away from the platen 16. The sheet pressing plate 606 is roughly L-shaped in cross section, and is attached to one of the lateral walls of the platen 16, which is perpendicular to the sheet pressing surface of the sheet pressing plate 606. The sheet pressing plate 606 is precisely positioned by being attached to the lateral wall of the platen 16. The sheet pressing plate 606 is desired to be formed of elastic substance for the following reason. That is, if a recording medium jams the recording apparatus, or the like incidence occurs, a user sometimes forcefully lifts the sheet pressing portion of the sheet pressing plate 606, causing thereby the sheet pressing plate 606 to bend, in order to remove the recording medium. However, with the sheet pressing member 606 formed of elastic substance, it restores itself into the original shape and position. With the sheet pressing plate 606 precisely positioned relative to the lateral portion of the platen 16 as described above, a sufficient amount of distance is secured for providing the actual pressing portion of the sheet pressing plate 606 with a proper amount of elasticity.

After being pinched by the peripheral surface of the sheet discharging roller 11 and the toothed portion of the rowel-like wheel 14, the recording medium is discharged from the main assembly of the recording apparatus by the rotation of the sheet discharging roller 11. The recording apparatus is provided with the sheet delivery tray 18, which is attached to the base 19. The base unit 21 is provided with a recovery mechanism 15 for maintaining at a predetermined level the performance of the recording head 8 in terms of ink ejection. This recording head performance recovery mechanism 15 is located below the home position of the carriage 6.

Referring to FIG. 12, the recording head performance recovery mechanism 15 is provided with a cap slider 123, the movement of which is tied to the movement of the carriage 6. To the cap slider 123, a cap holder 122 is attached, by which caps 112 and 113 are held so that their openings face upward. The caps 112 and 113 are molded of rubber-like elastic substance. Also to the cap slider 123, a pair of wipers 118 and 119 for wiping the surface of the recording head 8 having the ejection orifices are attached so that they are raised upward from the cap slider 123. The substance of which the blades of the wipers 118 and 119 are molded is also a rubber-like substance.

The cap slider 123 is kept pressed down and leftward of the drawing, by an unshown pressing means to assure that the cap slider 123 comes into contact with the functional surface of each of the four cam portions 124, which are differentiated in lift in gradual steps so that the right-hand most cam portion 124 is highest in lift. The right-hand end of the cap slider 123 is provided with a bump 125, with which the carriage 6 comes into contact as the carriage 6 is moved into the home position. Thus, as the carriage 6 is moved rightward to be moved into the home position, the cap slider 123 is also moved rightward because its movement is tied to the movement of the carriage 6. During this movement of the carriage 6, the cap slider 123 is moved upward by the movement of the carriage 6 while sliding the functional surface of each of the cam portions 124. Also with this movement of the carriage 6, the surface of the recording head 8 at which the ejection orifices open is wiped by the wipers 118 and 119.

The wiper 118, the one on the left side, is for the recording head surface having the ejection orifices for color inks, and the wiper 119, the one on the right-hand side, is for the recording head surface having the ejection orifices for black ink. In other words, the wipers 118 and 119 are attached to the cap slider 123 so that they are precisely positioned to wipe the adjacencies of the column(s) of the black ink ejecting orifices and the columns of color ink ejecting orifices of the recording head 8 as the cap slider 123 is moved. That is, the above described structural arrangement ensures that the wipers 118 and 119 come into contact with the recording head surface having the ejection orifices, so that the wipers 118 and 119 contact the recording head surface having the ejection orifices, by a predetermined amount, in terms of the apparent amount by which the wipers 118 and 119 enter the recording head surface having the ejection orifices, at a predetermined angle, and with a predetermined amount of contact pressure.

As the carriage 6 is moved into the home position, the caps 112 and 113 are placed in contact with the surface of the recording head 8 having the ejection orifices, covering thereby the ejection orifices. Regarding this covering of the ejection orifices by the caps 112 and 113, the cap slider 123 is pivotally supported by the cap holder 122, and also, is kept pressured upward, being thereby allowed to pivot within a predetermined range, to ensure that the caps 112 and 113 evenly and airtightly contact the surface of the recording head 8 having the ejection orifices. The cap 112, the one on the left side, is for the cap for covering the ejection orifices for color inks, and the cap 113, the one on the right side, is for covering the ejection orifices for black ink. The caps 112 and 113 are connected to a negative pressure generating means such as a vacuum pump through a tube or the like.

The main case unit 22 (FIGS. 8 and 9) is provided with a main case 33 which covers the above described recording unit 20 and base unit 21, from the top and lateral directions. The main case 33 is removably attached to the recording unit and base unit with the use of small screws or the like. The aforementioned rowel-like wheel 14 is supported by its axle and the main case 33, being positioned so that as the main case 33 is attached to the recording unit and base unit, it opposes the sheet discharging roller 11. The rowel-like wheel 14 is kept pressed on the sheet discharging roller 11 by an unshown pressing means.

The main case 33 is immovably attached to the base 19 with the use of hooks and small screws. Further, the adjacencies of the right-hand end 613 (FIG. 9) of the guide portion 4 (rail portion, that is, top edge portion of chasses 1) is sandwiched by the ribs of the main case 33, with the presence of a certain amount of play, in terms of the recording medium conveyance direction, being thereby restricted in width. This play is desired to be roughly 0.5 mm. Referring to FIGS. 9 and 11, the left end portion of the chassis 1 is bent rearward, and the top portion of this rearwardly bent portion is inwardly bent and provided with two round holes 612, which correspond in position to the two bosses with which the main case 33 is provided. The relationship in terms of size between the round holes 612 and bosses of the main case 33 are set so that a certain amount of play is provided between the main case 33 and chassis 1, in terms of the direction parallel to the surface having the holes 612 (surface having bosses). This play is desired to be roughly 0.5 mm.

The top end portion of the R lateral portion 57 of the chassis 1, which is located at the right end portion of the sheet feeding unit 49 located in the rear portion of the chassis 1 is bent inward, and provided with two round holes 614 (FIG. 9), which correspond in position to the two bosses with which the main case 33 is provided. The relationship in terms of size between the round holes 614 and corresponding bosses of the main case 33 are set so that a certain amount of play is provided between the main case 33 and chassis 1, in terms of the direction parallel to the surface having the holes 614 (surface having bosses). This play is desired to be roughly 0.5 mm. The main case 33 is immovably attached to the base 19, while providing a certain amount of play between the chassis 1 of the recording unit 20 and the R lateral portion 57 of the sheet feeding unit 59. Therefore, the recording apparatus in this embodiment is substantially greater in the overall rigidity than a recording apparatus in accordance with the prior art.

As for the usage of the ink jet recording apparatus in this embodiment, this recording apparatus is connected to a host computer, for example, to record images by receiving recording commands and image formation data from the host computer. As a recording command is received, the plurality of recording mediums 24 in the ASF tray 27 are fed into the main assembly of the ink jet recording apparatus while being separated one by one, by the ASF unit 54. Then, each recording medium 24 is conveyed by the conveyance roller 2 to the predetermined recording position. Then, the carriage 6 is reciprocally moved, while the recording head 8 is driven according to the image formation data (ink is ejected from ejection orifices selected according to image formation data). As a result, an image is formed on the recording medium.

When no image is formed, the carriage 6 is moved into the home position, and kept therein. During this movement of the carriage 6 into the home position, the surface of the recording head having the ejection orifices is wiped by the wipers 118 and 119. As a result, the ink and debris having adhered to the recording head surface having the ejection orifices are removed. Further, the ejection orifices of the recording head 8 are capped with the caps 112 and 113, preventing thereby the bodies of ink in the ejection orifices from evaporating or increasing in viscosity due to the evaporation of liquid components therefrom. Further, a pumping unit 120 is driven as necessary, with the ejection orifices capped with the caps 112 and 113. As a result, the ink is suctioned out of the ejection orifices, removing thereby the body of ink having increased in viscosity, residual bubbles, debris, etc.

In the recording apparatus in this embodiment of the present invention described above, the recording unit 20, conveyance roller 2, platen 16, sheet feeding unit 49 (first and second sheet feeding units 54 and 55) are precisely positioned relative to the base unit 21 and fixed thereto, being thereby supported by the base unit 21, so that they are disposed relative to each other at a high level of parallelism. Thus, the amount of load borne by the chassis of this recording apparatus is substantially smaller than the amount of load borne by the chassis of a recording apparatus in accordance with the prior art, in which the conveyance unit, recording unit, and sheet feeding unit are supported by the chassis. Further, the recording apparatus in this embodiment is substantially stronger and more rigid, in spite of being less expensive, being therefore capable of always yielding images of higher quality, than a recording apparatus in accordance with the prior art.

Also in this embodiment described above, the recording apparatus is structured so that the sheet feeding unit 49 is provided with the first sheet feeding unit which conveys the recording medium 24 to the recording unit 20 from the rear side of the recording unit 20, and the second sheet feeding unit which conveys the recording medium 63 to the recording unit 20 from the bottom side of the recording unit 20 through the U-turn sheet passage. With the employment of this structural arrangement, the recording unit 20, conveyance roller 2, first sheet feeding unit 54, and second sheet feeding unit 55 can all be precisely positioned to the base unit 21, and be fixed thereto, making it possible to substantially reduce the amount of load borne by the chassis, compared to a recording apparatus structured in accordance with the prior art, in which the platen unit, recording unit, sheet feeding unit are supported by the chassis.

In other words, according to this embodiment of the present invention, the recording apparatus is provided with a base which is capable of precisely supporting each of the units, which make up the recording apparatus, while being simple in structure and inexpensive. Therefore, each unit of the recording apparatus is made to precisely operate, and therefore, the image forming apparatus is enabled to form image at a high level of precision. This kind of characteristic is one of the most important characteristics, in technical terms, required of an ink jet recording apparatus which forms images by ejecting ink onto recording medium from its recording head(s). In other words, while the present invention is applicable to recording apparatuses of various types, it is most remarkable when applied to an ink jet recording apparatus in order to solve the above described technical problems of various recording apparatuses.

Further, not only is the present invention applicable to a monochromatic recording apparatus, but also, a color recording apparatus which records color images with the use of a plurality of inks different in color and a single or plurality of recording heads, a recording apparatus capable of recording images with the use of a plurality of inks identical in color, but different in density, and a single or plurality of recording heads, and combination of the preceding recording apparatuses.

According to the present invention, it is possible to improve a recording apparatus in terms of the level of quality at which it produces images, by precisely positioning and supporting each of the structural components of the recording apparatus. Further, it is possible to reduce the amount of the load borne by the chassis, making it possible to provide a recording apparatus substantially lower in cost than a recording apparatus in accordance with the prior art.

While the invention has been described with reference to the structures disclosed herein, it is not confined to the details set forth, and this application is intended to cover such modifications or changes as may come within the purposes of the improvements or the scope of the following claims.

This application claims priority from Japanese Patent Application No. 174967/2004 filed Jun. 14, 2004 which is hereby incorporated by reference.

What is claimed is:

1. A recording apparatus for effecting recording on a recording material by recording means, said apparatus comprising:

a carriage for reciprocal movement while carrying said recording means;

a platen for supporting the recording material at a position opposed to said recording means;

a conveyance roller for conveying the recording material;

a pinch roller driven by said conveyance roller;

a recording unit for supporting said carriage and said pinch roller;

a sheet feeding unit comprising a first sheet feeding portion unit for feeding the recording material from a rear part of said apparatus and a second sheet feeding unit for feeding the recording material to said recording unit from a lower portion of said recording apparatus, said sheet feeding unit positioned by sandwiching the first sheet feeding unit and the second sheet feeding unit by a first lateral plate of the chassis and a second lateral plate of the chassis; and a base unit for positioning and fixing said recording unit, said platen, said conveyance roller and said sheet feeding unit.

2. An apparatus according to claim 1, wherein said first sheet feeding unit includes a first sheet feeding roller for feeding the recording material, and a first support base supporting said first sheet feeding roller, and wherein said second sheet feeding unit includes a second sheet feeding roller for feeding the recording material, an intermediary roller disposed downstream of said second sheet feeding roller with respect to a feeding direction of the recording material, and a second support base supporting said second sheet feeding roller and said intermediary roller.

3. An apparatus according to claim 2, wherein an axis of said second support base relative to said base unit and an axis of said conveyance roller are positioned to be parallel with each other.

4. An apparatus according to claim 2, wherein an axis of said second support base relative to said base unit and an axis of said second sheet feeding roller are positioned to be parallel with each other.

5. An apparatus according to claim 2, wherein an axis of said second support base relative to said base unit and an axis of said intermediary roller are positioned to be parallel with each other.

6. An apparatus according to claim 2, wherein an axis of said second support base relative to said base unit and axis of said first support base relative to said base unit are positioned to be parallel with each other.

7. An apparatus according to claim 2, wherein an axis of said first support base relative to said base unit and an axis of said first sheet feeding roller are positioned to be parallel with each other.

8. An apparatus according to claim 1, wherein said conveyance roller has one end which is supported by said base unit and an other end supported by a LF chassis positioned on said base unit, and wherein a conveyance roller supporting portion of said LF chassis, a base unit mounting portion of said LF chassis, and a conveyance roller supporting portion of said base unit are positioned relative to a common axis perpendicular to a conveying direction of the recording material.

9. An apparatus according to claim 1, wherein said platen includes a guiding member for limiting rising of the recording material toward said recording means.

10. An apparatus according to claim 1, wherein said base unit includes a base member which is a resin material molded part.

11. An apparatus according to claim 1, wherein said platen is a molded part of resin material having an anti-electrification property.

12. An apparatus according to claim 1, wherein said recording means is ink jet recording means for effecting recording by ejecting ink.

* * * * *